United States Patent [19]

Graef et al.

[11] 3,999,681

[45] Dec. 28, 1976

[54] ROTARY CASH DRAWER OPERATING MECHANISM

[75] Inventors: Harry T. Graef, Dover; Larry A. Morrison, North Canton, both of Ohio

[73] Assignee: Diebold, Incorporated, Canton, Ohio

[22] Filed: Jan. 15, 1976

[21] Appl. No.: 649,539

[52] U.S. Cl. ..... 221/9; 221/266

[51] Int. Cl.[2] ..... G06C 29/00

[58] Field of Search ..... 221/9, 10, 266, 12, 221/256, 257, 258; 133/4 R; 194/4; 312/251; 232/44

[56] References Cited

UNITED STATES PATENTS 3,880,320 4/1975 Morello et al. ..... 221/266 X

*Primary Examiner*—Stanley H. Tollberg
*Attorney, Agent, or Firm*—Frease & Bishop

[57] ABSTRACT

Mechanism for operating a rotary cash drawer provided in an automatic banking unit. The cash drawer is movable between "home", "open", and "dump" positions for receiving paper money at the "home" position to be delivered at the "open" position, for accepting deposits in the "open" position, and for dumping at the "dump" position deposits, or money left in the drawer and not removed at the "open" position. The operating mechanism includes a simplified rotor movement control cam, a cooperating pair of solenoids, and a reversing drive motor. These control movement of the rotary cash drawer between the various positions, lock the rotary cash drawer in "home" position, and prevent retrograde rotor movement at certain times during the cycle of drawer operation.

10 Claims, 15 Drawing Figures

ROTARY CASH DRAWER OPERATING MECHANISM

CROSS REFERENCE TO RELATED PATENTS

The drawer operating and control mechanism comprises improvements on the construction shown in U.S. Pat. No. 3,880,320, dated Apr. 29, 1975.

BACKGROUND OF THE INVENTION

1. Field of the Invention

The invention relates to currency dispensing and deposit-accepting rotary cash drawer means used as a part of automatic banking equipment in which the cash drawer rotor has a pocket which receives a requested amount of currency from a stored currency supply at "home" position, delivers the currency to an "open" position for removal, can accept deposits in the "open" position, and then moves to a "dump" position to dump the deposits into a safe or protected compartment in the banking unit, or to dump currency which may not have been removed while the rotor was at the "open" position. More particularly, the invention relates to an improved, simplified, readily adjusted and inexpensive drive, operating and control mechanism for the cash drawer rotor.

2. Description of the Prior Art

The prior construction of U.S. Pat. No. 3,880,320, of which the operating and control mechanism of the invention is an improvement, involves a direct drive motor for rotating the drawer rotor in one direction, a friction drive motor for rotating the rotor in the other direction, a pivotal motor mount plate carrying the two drive motors, and means for pivotally moving the motor mount plate between positions for engaging one or the other drive motors with the rotor. A ratchet wheel prevents rotary movement of the rotor in one direction at certain times, and separate lock pin means locks the rotor in "home" position.

It has been discovered that this prior operating and control mechanism is difficult to adjust and maintain in adjustment. Further difficulties have been encountered in controlling and coordinating the operation of the two motors. Further, the drive construction has a high cost because of the use of two drive motors of different types and kinds.

Thus, a need has developed for a rotary cash drawer operating and control mechanism for the rotary cash drawer means of a banking unit currency dispenser and depository which eliminates the difficulties that have been encountered in the operation and use of prior devices.

SUMMARY OF THE INVENTION

Objectives of the invention include providing simplified operating and control mechanism for automatic banking unit cash drawers such as shown in U.S. Pat. No. 3,880,320; providing such mechanism with coordinated low-torque reversing motor and cam and solenoid movement control means for rotor movement between "home", "open" and "dump" positions; providing such mechanism which acts without other components as "home" position lock means; providing such mechanism which also acts as anti-retrograde rotor movement means; providing such construction which avoids critical adjustment of mechanism components; providing a construction which eliminates prior multiple motor and pivoted motor mounting drive means; and providing a construction which achieves the stated objectives in an effective, easily serviced manner, thereby solving problems which have been encountered in the prior operation and control of rotary cash drawer constructions of the type described.

These and other objects and advantages may be obtained by the new operating and control mechanism for automatic banking unit rotary cash drawer rotors, the general nature of which may be stated as including a low-torque reversing motor for driving a cash drawer rotor between "home", "open" and "dump" positions; rotary cam means mounted on the rotor having stop shoulder means; solenoid means having movable armature stop pins selectively engageable with the cam means stop shoulder means; and means for selectively actuating the solenoid means to control rotor movement between said "home", "open" and "dump" positions, to lock the rotor in "home" position, and to prevent retrograde rotor movement after "home" position has been reached during movement toward "dump" position.

BRIEF DESCRIPTION OF THE DRAWINGS

A preferred embodiment of the invention — illustrative of the best mode in which applicants have contemplated applying the principles — is set forth in the following description and shown in the drawings and is particularly and distinctly pointed out and set forth in the appended claims.

Similar numerals refer to similar parts throughout the various figures of the drawings.

DESCRIPTION OF THE PREFERRED EMBODIMENT

Figure 1:
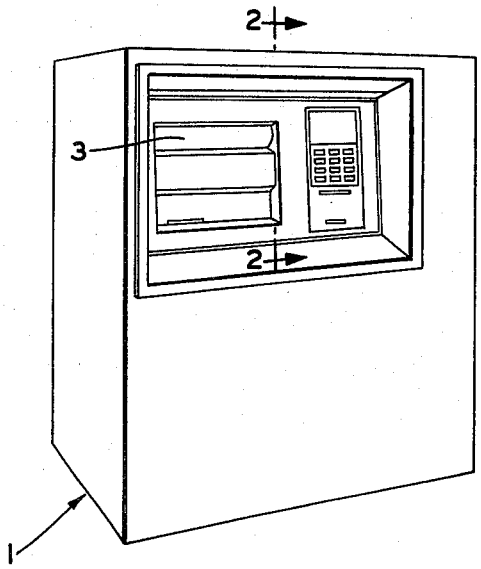
FIG. 1 is a diagrammatic perspective view of a remote automatic banking unit having currency dispensing and depository mechanism incorporating the new rotary cash drawer operating mechanism.
Figure 2:
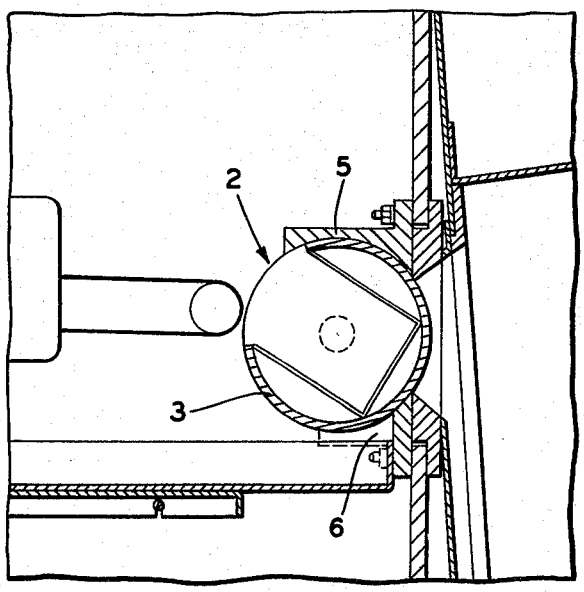
FIG. 2 is a fragmentary sectional view, with parts broken away, taken on the line 2—2, FIG. 1 illustrating the rotary cash drawer assembly mounted within the banking unit housing.
Figure 3:
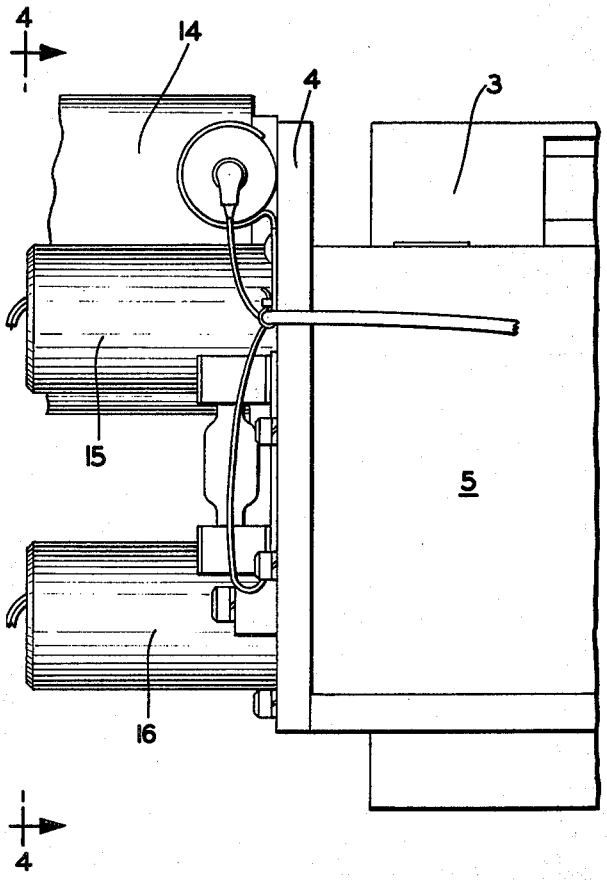
FIG. 3 is a top plan view of a portion of one end of the rotary cash drawer mechanism shown in U.S Pat. No. 3,880,320, equipped with the new operating and control mechanism.

The banking unit generally indicated at 1 and the rotary drawer construction generally indicated at 2 in FIG. 2 are of the same type as shown in U.S. Pat. No. 3,880,320. FIGS. 3 to 15 illustrate the improved operating and control mechanism concept of the invention which replaces the drive mechanism shown, for example, in FIGS. 4 and 5 of U.S. Pat. No. 3,880,320 at the left-hand end of the rotary drawer construction illustrated.

The rotary cash drawer 2 has a rotor 3 journaled at one end in an end frame member 4 connected between upper and lower frame members 5 and 6. Rotor 3 is movable between "home" position shown in FIG. 9, "open" position shown in FIG. 11, and "dump" position shown in FIG. 13.

Figure 5:
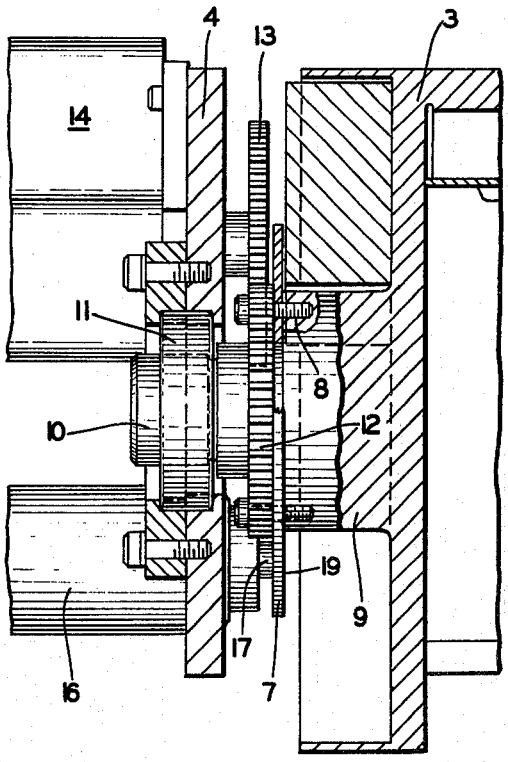
FIG. 5 is a plan sectional view taken on the line 5—5, FIG. 4.

In accordance with the invention, a cam control plate 7 is mounted by bolts 8 on the stub shaft 9 of rotor 3. The outer end 10 of stub shaft 9 is journaled in a bearing 11 carried by the end frame member 4 (FIGS. 4 and 5).

Figure 6:
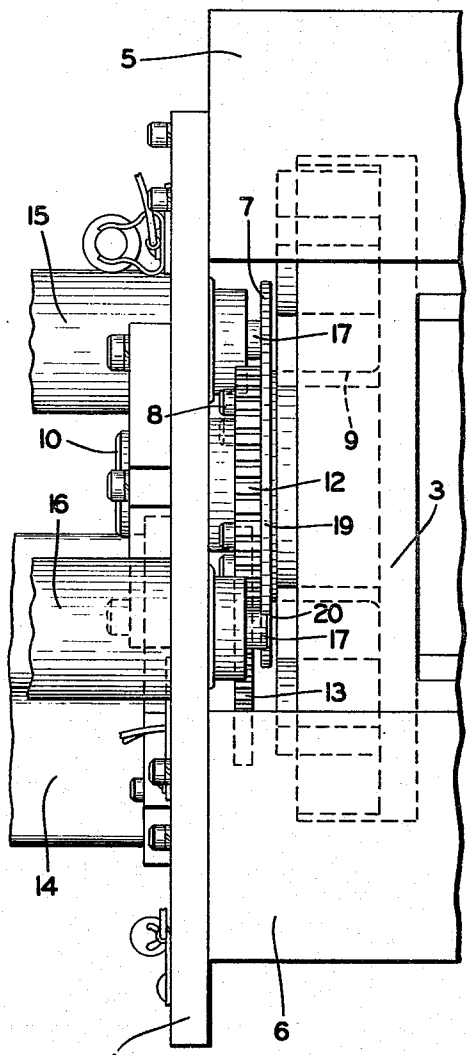
FIG. 6 is a front elevation with parts broken away looking in the direction of the arrows 6—6, FIG. 4.
Figure 7:
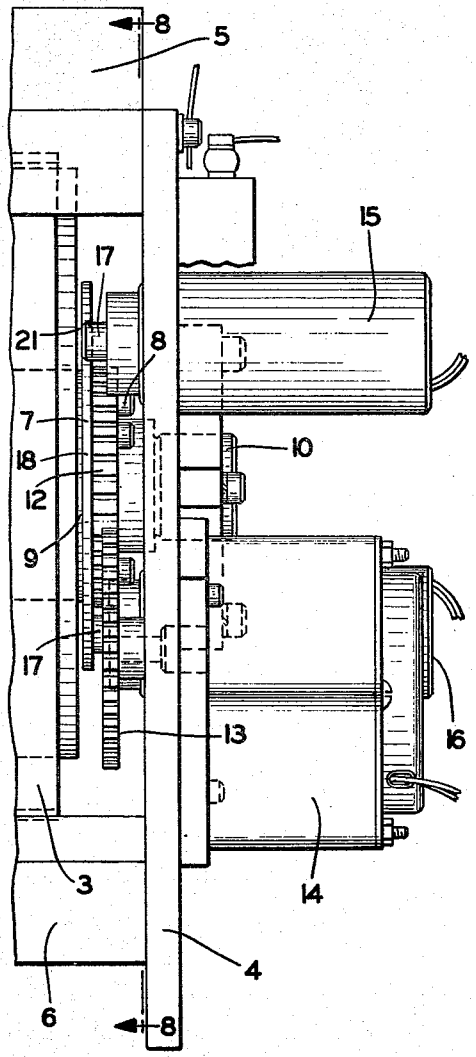
FIG. 7 is a rear elevational view looking in the direction of the arrows 7—7, FIG. 4.

A driven gear 12 also is bolted along with cam 7 to the rotor stub shaft 9 (FIGS. 7 and 8), and gear 12 is driven by gear 13 which in turn is driven by drive motor 14. Motor 14 is carried by end frame member 4 as shown in FIGS. 4, 6, and 7, and the motor is a low-torque, reversing motor having a sufficient torque output to rotate the rotor 3 in either direction between the various positions shown in FIGS. 9, 11 and 13.

However, the low-torque characteristic of drive motor 14 is such that if movement of a member driven thereby is obstructed, the motor acts as a slip-clutch. Thus, if a customer's hand has not been removed from the pocket of rotor 3 when the rotor in "open" position shown in FIG. 11 starts to move, and the hand is trapped between the rotor and the upper frame member 5 as the rotor rotates counterclockwise from the position of FIG. 11 to that of FIG. 13, insufficient rotating torque is supplied by the motor 14 to continue rotor movement which otherwise would injure the customer. In other words, the drive torque yields to an obstruction or the holding of the rotor 3 against movement when it is trying to drive the rotor.

Figure 4:
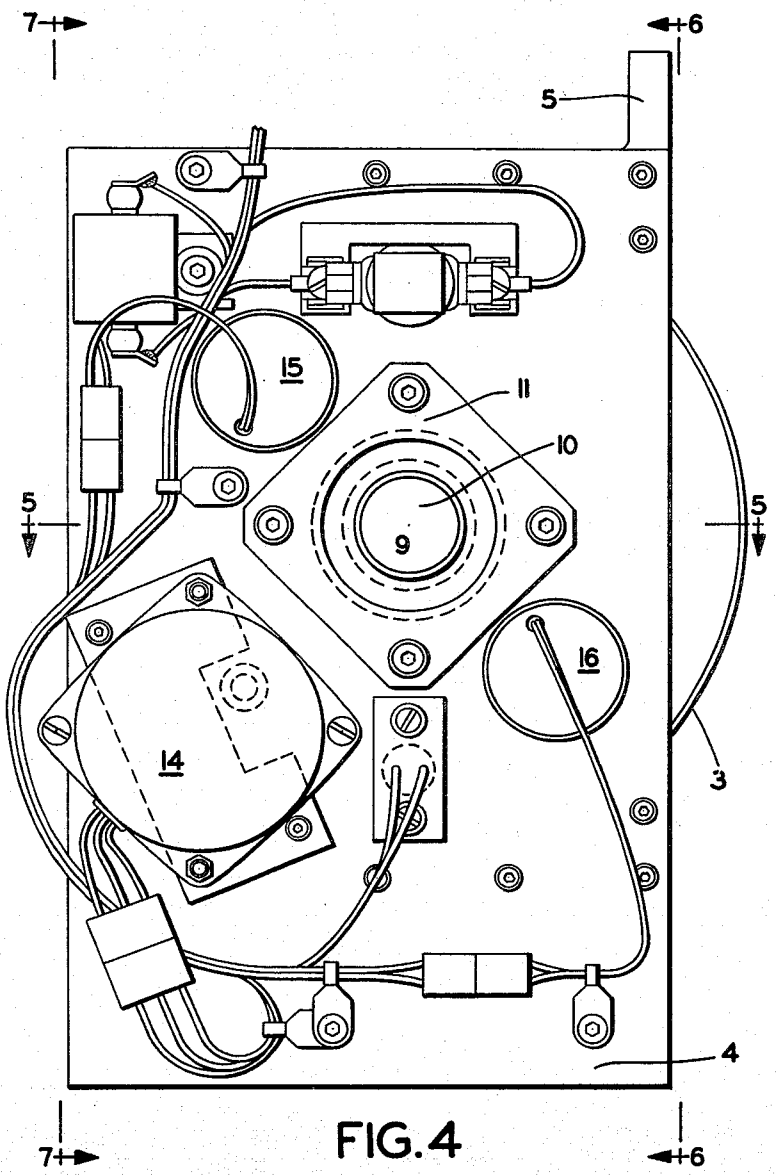
FIG. 4 is an end view of the equipment shown in FIG. 3 looking in the direction of the arrows 4—4, FIG. 3.

The improved control mechanism includes two solenoids, the upper one being indicated at 15 and the lower one at 16 in FIG. 4. The armature or blocking shaft of each solenoid is indicated at 17 in FIGS. 14 and 15. The armature of solenoid 15 is shown in retracted position in FIG. 14 associated with the rotor "dump" position of FIGS. 12 and 13 and the armature 17 of solenoid 15 is shown in extended blocking position in FIG. 15, which corresponds to the position of the armature in FIGS. 8 and 9 when the rotor 3 is at "home" position.

Figure 10:
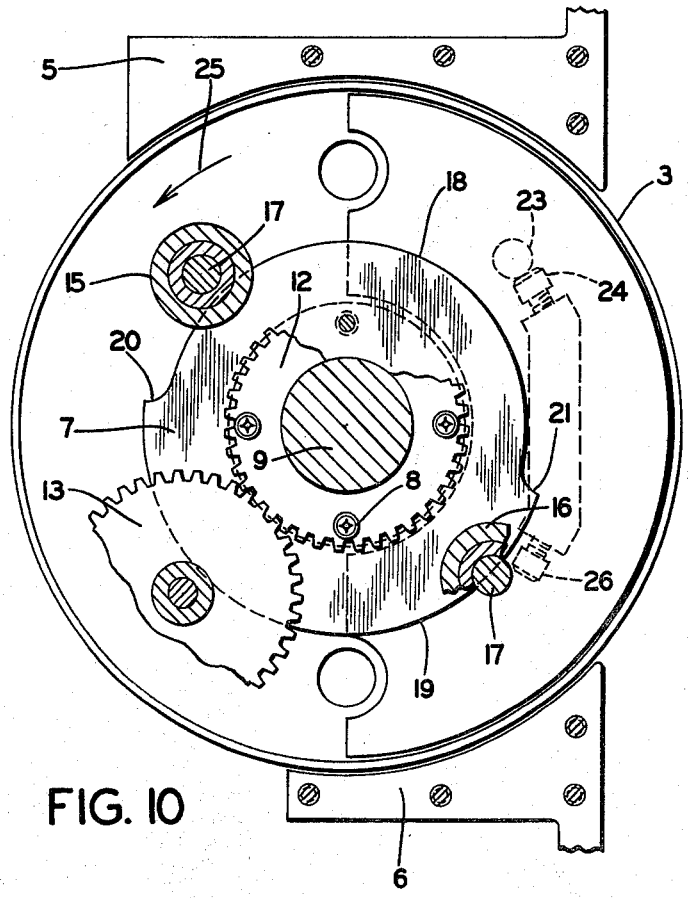
FIG. 10 is a view similar to FIG. 8 showing the operating and control mechanism in "open" position.

Cam 7 has a small diameter circular contour or segment extending for slightly more than 180°, as best shown in FIG. 10 at 18 and a large diameter circular contour 19. The circular cam contours or segments 18 and 19 are connected with each other by stop shoulders 20 and 21.

Figure 8:
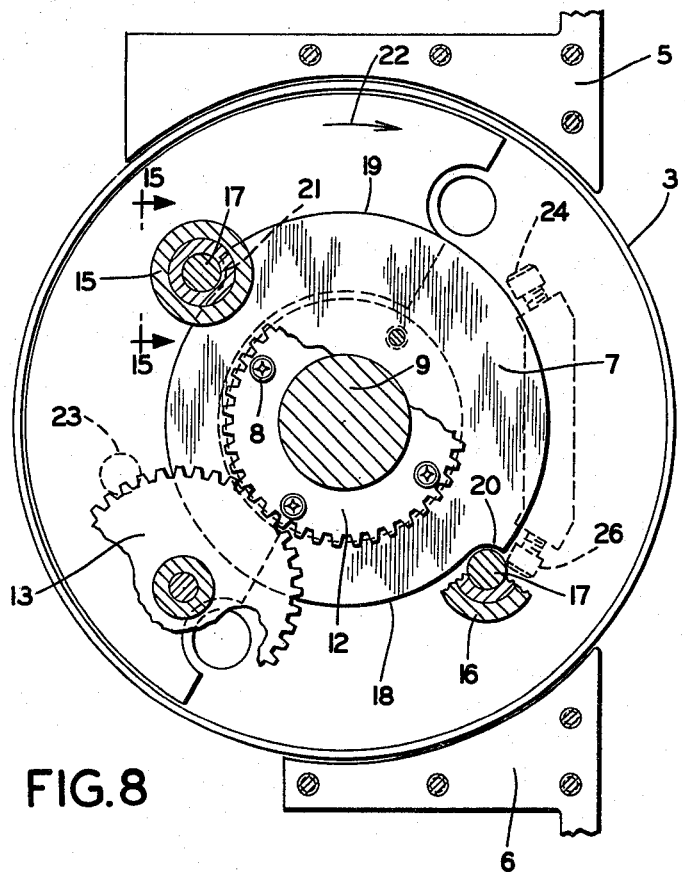
FIG. 8 is a section with parts broken away taken on the line 8—8, FIG. 7 showing the operating and control mechanism in "home" position.
Figure 9:
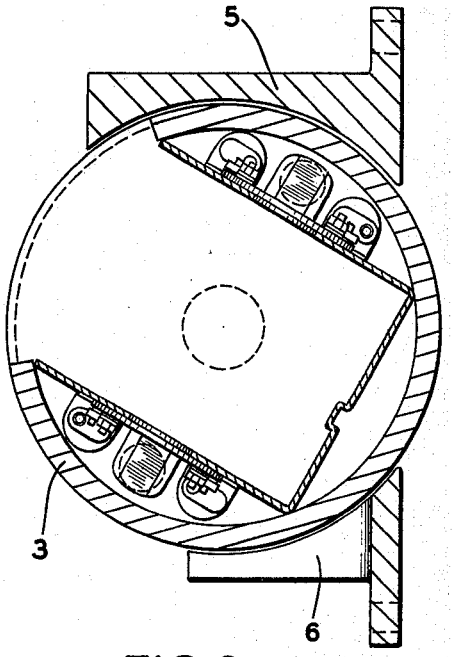
FIG. 9 is a cross-sectional view of the rotor corresponding to the "home" position of FIG. 8.

In operation, when the rotor 3 is at rest in the "home" position of FIGS. 8 and 9, the armatures 17 of both solenoids 15 and 16 are in extended position, blocking stop shoulders 20 and 21, thus holding rotor 3 locked at "home" position. Thus, the cam control armatures perform a locking function and eliminate the lock pin 71 of U.S. Pat. No. 3,880,320.

Figure 11:
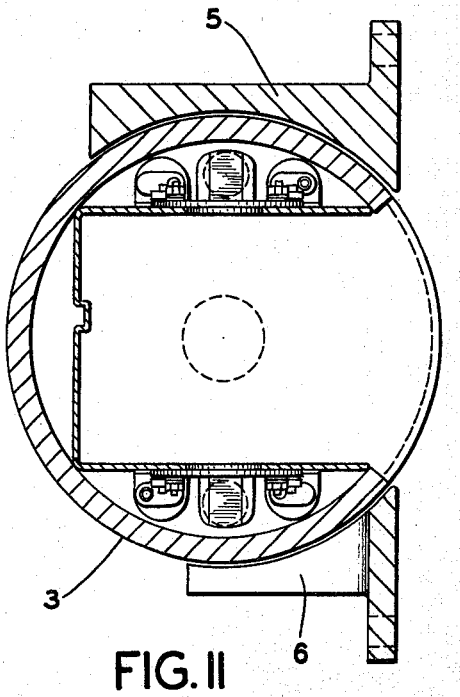
FIG. 11 is a view similar to FIG. 9 with the rotor in "open" position.

When rotary drawer operation is energized to rotate rotor 3 clockwise from the position of FIG. 8 to that of FIG. 10 to move the rotor compartment to the "open" position shown in FIG. 11, the armature 17 of lower solenoid 16 is retracted, thus disengaging stop shoulder 20 of cam 7 which permits clockwise rotor movement indicated by the arrow 22 in FIG. 8. When the rotor 3 reaches "open" position of FIGS. 10 and 11, a stop pin 23 on the rotor engages a stop 24 carried by the frame. The stop pin 23 and the stop member 24 are shown in dot-dash lines in FIGS. 8, 10 and 12 and are located at the right end of the rotor and frame, with reference to FIG. 6. Pin 23 and member 24 are the same members as those shown at 47 and 69 in FIGS. 10 and 11 of U.S. Pat. No. 3,880,320.

At the same time that solenoid 16 is activated to withdraw its armature 17, motor 14 is energized to drive rotor 3 clockwise to the "open" position of FIG. 11.

Figure 13:
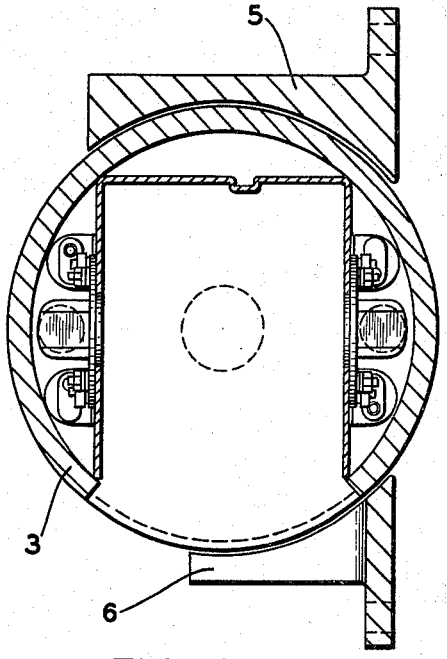
FIG. 13 is a view similar to FIGS. 9 and 11 showing the rotor in "dump" position.

After banking material has been removed from the rotor pocket at "open" position in FIG. 11, or after a deposit has been made in such pocket, the drive motor 14 is energized to rotate the rotor 3 counterclockwise as shown by the arrow 25 in FIG. 10 from the position of FIG. 11 toward the "dump" position of FIG. 13.

Figure 14:
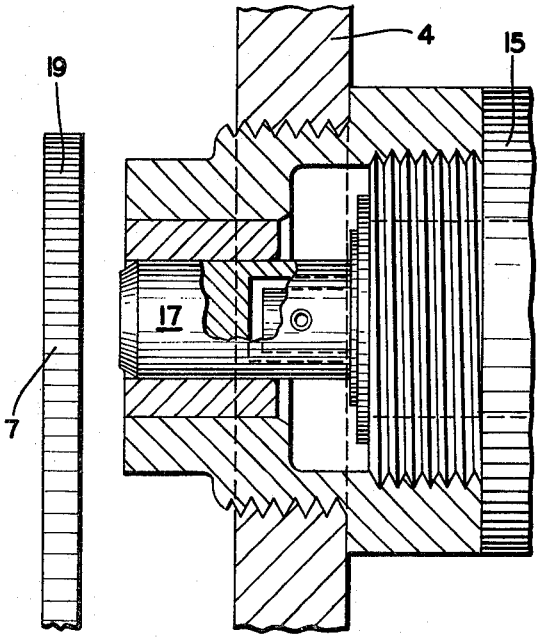
FIG. 14 is an enlarged fragmentary sectional view looking in the direction of the arrows 14—14, FIG. 12 showing one of the control solenoids in retracted position.
Figure 15:
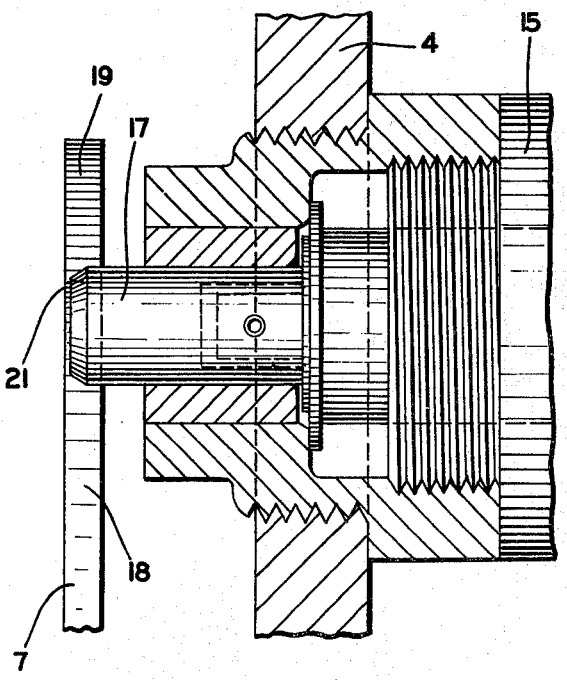
FIG. 15 is a view similar to FIG. 14 looking in the direction of the arrows 15—15, FIG. 8 showing the solenoid in extended position locking a rotary drawer in "home" position.

The armature 17 of solenoid 15 which was in extended position engaged with stop shoulder 21 of cam 7 when rotor 3 was at "home" position, and which continued to be in extended position while rotor 3 rotated clockwise toward and while at the "open" position of FIG. 11, is moved to retracted position of FIG. 14 during rotation of rotor 3 counterclockwise from "open" position of FIG. 11 to "dump" position of FIG. 13. Such positioning of the armature 17 of solenoid 15 is necessary so that stop shoulder 21 is not engaged by the armature 17 of solenoid 15 as the cam 7 moves counterclockwise from the position of FIG. 10 to that of FIG. 12.

Figure 12:
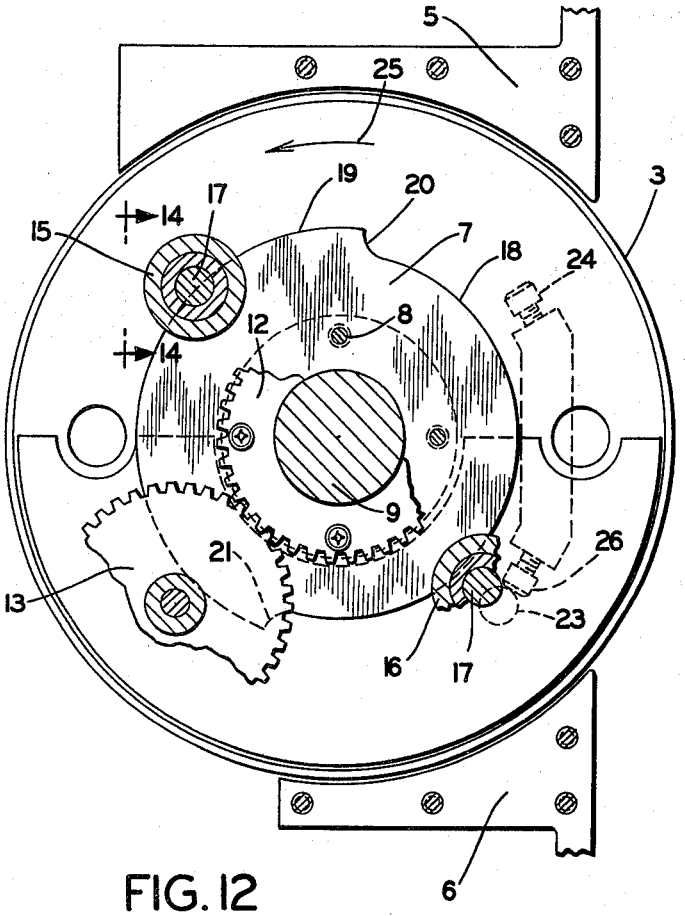
FIG. 12 is a view similar to FIGS. 8 and 10 showing the operating and control mechanism in "dump" position.

Meanwhile, armature 17 of solenoid 16 is released so that it can move to extended position as soon as stop shoulder 20 passes by the solenoid 16 in moving counterclockwise from the position of FIG. 10 to that of FIG. 12. In this manner, as the cam 7 reaches the position of FIG. 8 during such counterclockwise rotation from the "open" to the "dump" position, the armature 17 of solenoid 16 assumes an extended position engageable with stop shoulder 20 so as to block retrograde or clockwise movement of rotor 3 if any attempt is made by an unauthorized person to perform some fishing operation of material present in the rotor pocket intended to be dumped.

In this manner, the ratchet wheel 102 and pawl 103 of U.S. Pat. No. 3,880,320 are unnecessary to protect against clockwise movement of the rotor 3 and can be eliminated.

After rotor 3 has reached the "dump" position of FIG. 13 and the contents of the rotor pocket dumped, rotor movement is reversed by reversing the operation of motor 14, and rotor 3 moves clockwise from the position of FIG. 12 to that of FIG. 8. The armature 17 of solenoid 16 at this time engages stop shoulder 20 to block further movement clockwise of rotor 3. When rotor 3 arrives at "home" position of FIG. 9, the armature 17 of upper solenoid 15 which had been released, moves to extended position engaging stop shoulder 21 of cam 7. Thus, the armatures of the solenoids block the rotor 3 against movement in either direction at "home" position until a new cycle of operation is activated.

During rotor movement from "open" to "dump" position, the stop pin 23 carried by the rotor moves counterclockwise from the position of FIG. 10 to that of FIG. 12 and engages top member 26 carried by the frame to stop further counterclockwise movement of rotor 3. Stop 26 corresponds to the member 70 of FIG. 11 of U.S. Pat. No. 3,880,320.

Reversing drive motor 14 is a weak low-torque motor that stalls when rotor 3 encounters an obstruction or manual resistance. It has sufficient torque to drive the rotor 3 in either direction. The rotor, unless locked, can be moved manually. However, when rotating counterclockwise (FIGS. 8, 10, 12), and passing "home" position, rotor 3 cannot be manually moved clockwise past "home" position because of the solenoid armature engagement with stop shoulder 20 of cam 7.

Accordingly, the present invention provides substantial improvements in operating and control mechanism for the cash drawer rotor, over that shown in U.S. Pat. No. 3,880,320; provides a simplified cam and solenoid construction cooperatively related with a low torque reversing drive motor, which effectively controls rotor movement and locks the rotor at "home" position, thereby eliminating the necessity for additional locking bolts and pawl and ratchet components to provide the necessary security for rotor operation; provides a construction eliminating one of two motors heretofore used for driving the rotor as well as eliminating pivoted motor mounting plate devices for alternate engagement of one or another of two drive motors; provides an operating and control mechanism which is easy to adjust and coordinate with other cash drawer controls; and provides a construction which achieves the objectives stated, eliminates difficulties heretofore encountered in the construction and operation of rotary cash drawers of the type described.

In the foregoing description, certain terms have been used for brevity, clearness and understanding; but no unnecessary limitations are to be implied beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the new rotary cash drawer is constructed and operated, and the advantageous, new and useful results obtained; the new and useful structures, devices, components, elements, arrangements, parts, combinations, systems, equipment, operations, and relationships are set forth in the appended claims.

We claim:

1. Operating and control mechanism for automatic banking unit rotary cash drawer construction of a type in which the drawer includes a rotor mounted in a rotor housing having a banking media-containing pocket, and in which the rotor is movable between "home", "open" and "dump" positions; the mechanism including low-torque, reversing motor drive means mounted on the rotor housing for moving the rotor selectively between "home", "open" and "dump" positions; rotary cam means mounted on the rotor having stop shoulder means; solenoid means mounted on the housing adjacent the cam means having armature stop pin means movable between projected and retracted positions selectively engageable with the cam means stop shoulder means; and means for selectively actuating the armature stop pin means to control rotor movement between said "home", "open" and "dump" positions, to lock the rotor in "home" position, and to prevent retrograde rotor movement after "home" position has been reached during rotor movement toward "dump" position.

2. The mechanism defined in claim 1 in which the reversing drive motor has torque characteristics which drive the motor in either direction when the rotor is unobstructed, and in which the motor stalls when rotor movement is obstructed.

3. The mechanism defined in claim 2 in which the rotor is manually movable against the torque resistance of the drive motor.

4. The mechanism defined in claim 1 in which the cam means has two surface segments, and in which the ends of the two cam surface segments are connected respectively by said stop shoulder means.

5. The mechanism defined in claim 4 in which each cam surface segment has a cylindrical contour, and in which one segment has a larger radius then the other, thereby providing the stop shoulder means at said connected ends.

6. The mechanism defined in claim 4 in which stop means are provided including a stop pin on the rotor and two stop members on the housing, and in which the stop pin if engageable with one stop member to limit rotor movement in one direction when the rotor arrives at "open" position, and is engaged with the other stop member to limit rotor movement in the other direction when the rotor arrives at "dump" position.

7. The mechanism defined in claim 1 in which the solenoid means includes two solenoids, in which the cam means has two stop shoulders, and in which the two stop shoulders are engaged respectively by projected armature stop pin means of the two solenoids when the rotor is stopped at "home" position to lock the rotor in "home" position.

8. The mechanism defined in claim 7 in which retraction of one armature stop pin means when the rotor is in "home" position permits rotor movement from "home" to "open" position.

9. The mechanism defined in claim 8 in which retraction of the other armature stop pin means when the rotor is in "open" position permits rotor movement from "open" to "dump" position.

10. The mechanism defined in claim 9 in which said one armature stop pin means is moved from retracted to extended position during rotor movement toward "dump" position to prevent retrograde rotor movement after the rotor moves past "home" position in its travel to "dump" position.

* * * * *